US005101189A

United States Patent [19]

Dolza et al.

[11] Patent Number: 5,101,189

[45] Date of Patent: Mar. 31, 1992

[54] ADJUSTABLE ELECTRIC THERMOSTAT

[75] Inventors: Luigi Dolza; Piero Zanon, both of Almese, Italy

[73] Assignee: C.A.E.M. S.r.l., Turin, Italy

[21] Appl. No.: 524,511

[22] Filed: May 17, 1990

[30] Foreign Application Priority Data

May 31, 1989 [IT] Italy ..... 53140/89[U]

[51] Int. Cl.[5] ..... H01H 37/12; H01H 37/36

[52] U.S. Cl. ..... 337/319; 337/347

[58] Field of Search ..... 337/319, 312, 347, 360, 337/368, 115, 129

[56] References Cited

U.S. PATENT DOCUMENTS 3,114,813 12/1963 Durst ..... 337/319

*Primary Examiner*—Harold Broome

*Attorney, Agent, or Firm*—Guido Modiano; Albert Josif

[57] ABSTRACT

The thermostat comprises a main housing (10) having a metal sheet cover (12) with a bored and threaded boss (18) and an adjustment shaft (20) threadedly engaged in said boss and entering the housing to interact with internal operative members of the thermostat. According to the invention, a plate (28) of yielding material is affixed against the inside of the metal sheet cover, said plate having a bore (30) aligned with the bored and threaded boss, of a diameter slightly less than the shaft diameter, and that the threaded end of the shaft is in interference fit with said bore.

7 Claims, 1 Drawing Sheet

ADJUSTABLE ELECTRIC THERMOSTAT

BACKGROUND OF THE INVENTION

This invention is concerned with an adjustable electric thermostat, particularly, but not exclusively, for electric home appliances.

For the adjustment of the reference temperature, such thermostats include a shaft having an outside knob, threadedly engaged with respect to the housing of the thermostat, so that the shaft end changes its position as the knob is rotated, thus displacing the home position of the heat probing member. In order for the threaded shaft to have a satisfactory engagement with the seat within which it rotates, the axial length of the seat should be, according to standard practice in mechanics, of at least about twice the shaft gauge, i.e., about 12 mm in the typical case of a 6 mm shaft. Seats having a smaller thickness make for unreliable couplings, because, with different dimensions due to manufacturing tolerances, either the resistance to rotation may be too high, or the coupling may be too loose and insufficient to assure that the angular position of the shaft be properly maintained in case of light shock or vibration.

In order to obtain the required thickness of the threaded portion, it is therefore usual to affix externally to the housing a metal washer of 10 to 12 mm thickness, usually attached to the metal sheet of the housing by riveting or punching. Such arrangement is expensive, and furthermore it undesirably increases the axial bulk of the thermostat. Because of this, it has been proposed to provide the threaded seat in a boss or lug obtained directly from the metal sheet from which the housing is made. The drawbacks caused by the small thickness (3 to 4 mm) of the seat are then avoided by cutting an axial slit in the hollow shaft and slightly flaring the slitted portion so that an elastic radial pressure is created between the shaft threads and the seat.

However, this approach, which requires an almost individual adjustment of the shaft, depending on the combinations of the dimensional tolerances which may arise between the seat and the shaft, can only be used when the thermostat is manually assembled, and it gives rise to unsurmountable difficulties in automatic assembly.

SUMMARY OF THE INVENTION

The primary object of this invention is therefore to provide an adjustable electric thermostat of the above kind, in which the manufacturing costs are reduced, particularly in automatic assembly, and to more particularly avoid both the need for individual line-ups in the assembled unit and the use of metal washers affixed to the thermostat housing for the threaded engagement of the adjustment shaft.

The invention achieves the above and other objects and advantages, such as they will appear from the following specification, by means of an adjustable electric thermostat comprising a main housing having a metal sheet cover with a bored and threaded boss and an adjustment shaft threadedly engaged in said boss and entering the housing to interact with internal operative members of the thermostat, characterized in that a plate of yielding material is affixed against the inside of the metal sheet cover, said plate having a bore aligned with the bored and threaded boss, of a diameter slightly less than the shaft diameter, and that the threaded end of the shaft is in interference fit with said bore.

BRIEF DESCRIPTION OF THE DRAWINGS

The invention will now be disclosed in more detail with reference to a preferred embodiment given by way of illustrative and non limiting example, and shown in the attached drawing, wherein.

DESCRIPTION OF A PREFERRED EMBODIMENT

Figure 1:
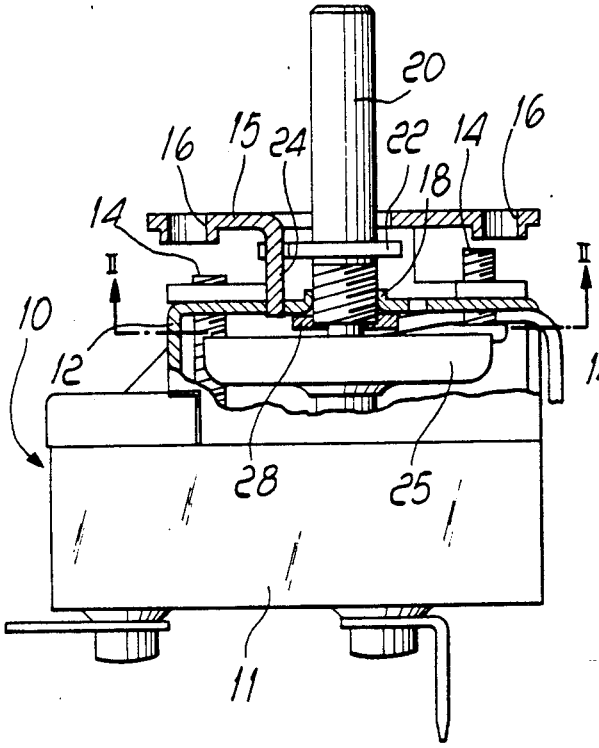
FIG. 1 is a partial view, in axial cross-section, of an adjustable electric thermostat incorporating the improvements of the invention.
Figure 2:
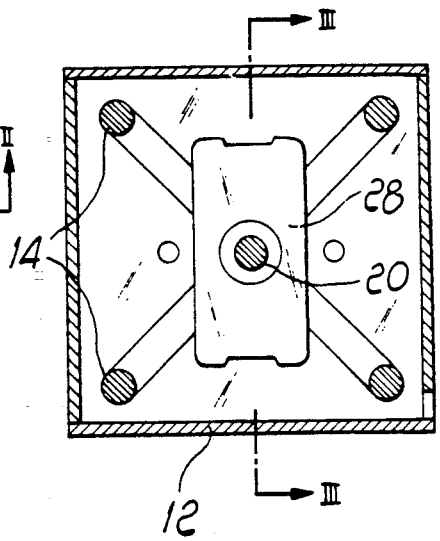
FIG. 2 is a view of the thermostat in cross-section made along line II—II of FIG. 1.
Figure 3:
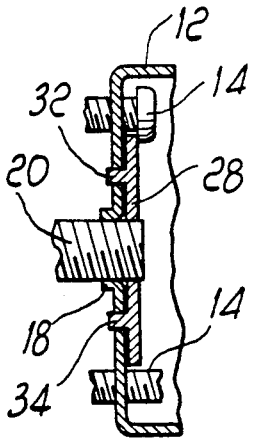
FIG. 3 is a view of a detail of the thermostat, in cross-section made along line III—III of FIG. 2.

With reference to FIGS. 1 and 2, an adjustable electric thermostat for an electric home appliance has a main housing 10 with a base 11 of ceramic material, containing electric contacts (not shown) and with a cover 12 of punched metal sheet, to which a bracket 15 is attached with screws 14, the bracket having threaded bores 16 for installation on the control panel of the appliance (not shown).

A bored and threaded boss 18 is made in cover 12, into which the threaded end of a shaft 20 is engaged. The opposite end of shaft 20 has an adjustment knob not shown. A cam 22 is attached to shaft 20, so that it can interact with a stop 24 obtained in bracket 16 in order to limit the rotation of the shaft. The inner end of shaft 20 abuts against an expansion member 25, known per se, which in turn drives the electric contacts (not shown) in ceramic base 11.

Figure 4:
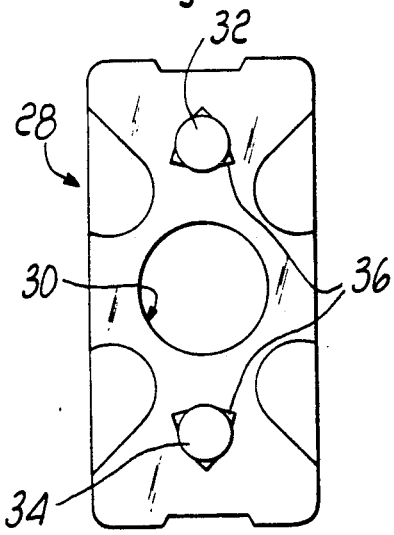
FIG. 4 is a front view of a plate belonging to the thermostat of FIG. 1, on an enlarged scale.
Figure 5:
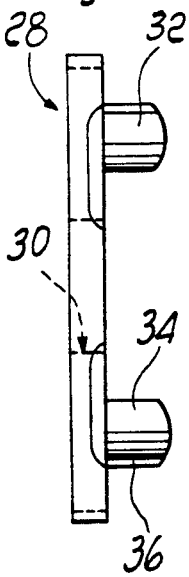
FIG. 5 is a lateral view of the plate of FIG. 4, on the same scale.

On opposite sides of boss 18, the metal sheet is punched with respective symmetrical holes, say of a diameter of 2 mm, and the inside surface of cover 12 bears a rectangular plate 28 (see also FIGS. 4 and 5), of a synthetic plastic material such as a polyamidic material loaded with fiber glass. Plate 28 is bored with a central hole 30, aligned with the threaded bore in boss 18, and further has respective pins or lugs 32, 34 on opposite sides of hole 30, pointing toward cover 12 and tightly fitted into the holes of the cover. Preferably the cross-section of lugs 32, 34 is round, with three radially projecting ribs such as 36.

The central bore 30 in plate 28 has a diameter slightly smaller than the diameter of the threaded end of the shaft, so that the latter can engage it with interference fit, distorting its wall. The friction between the plate and the shaft threads assures that the shaft meets a uniform but not excessive resistance to the rotation applied by the user, due to the compliance of the plate material, and with no risk that the shaft may depart from the chosen position as a result of vibrations or involuntary shock.

The braking action of the plate is tolerant of wide dimensional variations both in the lugs and in the central bore, without the need for calibration, and the operations required for assembly are easy to automatize, as it will be apparent for the person skilled in the art.

It is obvious that changes may be made to the preferred embodiment as disclosed above. For instance, the plate could take different shapes from a rectangle; the material could be a different polymer from the one mentioned; the fixing lugs might be replaced with snap tangs, or with an utterly different way of attachment from the interference fit, such as cementing or the like. These and other changes, in so far as they are fucntionally equivalent, should be regarded as falling within the scope of the invention.

We claim:

1. An adjustable electric thermostat comprising a main housing having a metal sheet cover with a bored and threaded boss and an adjustment shaft threadedly engaged in said boss and entering the housing to interact with internal operative members of the thermostat, characterized in that a plate of a yielding, synthetic plastic relatively soft polymeric material is affixed against the inside of the metal sheet cover, said plate having a bore aligned with the bored and threaded boss and having a diameter slightly less than the shaft diameter, so that the threaded end of the shaft is in interference fit with said bore.

2. An adjustable electric thermostat comprising:

a main housing having a metal sheet cover with a bored and thereaded boss and with two holes symmetric to the boss, an adjustment shaft thereadedly engaged in said boss and entering the housing to interact with internal operative members of the thermostat, a plate of yielding material having two lugs projecting from it with transverse cross-sections substantially round with projecting longitudinal ribs said lugs being in interference fit in said holes in the metal sheet cover, said plate having a bore aligned with the bored and threaded boss and having a diameter slightly less than the shaft diameter, so that the threaded end of the shaft is in interference fit in said bore.

3. The electric thermostat of claim 2, wherein said plate is of a polyamidic material loaded with fiberglass.

4. The electric thermostat of claim 3, wherein said plate has a rectangular shape.

5. An adjustable electric thermostat comprising a main housing (10) having a metal sheet cover (12) with a bored and threaded boss (18) and an adjustment shaft (20) threadedly engaged in said boss and entering the housing to interact with internal operative members of the thermostat, characterized in that a plate (28) of yelding material is affixed against the inside of the metal sheet cover, said plate having a bore (30) aligned with the bored and threaded boss, of a diameter slightly less than the shaft diameter, and that the threaded end of the shaft is in interference fit with said bore, wherein said plate is attached to the cover by interference fit of lugs (32, 34) projecting from the plate into respective holes made in the metal sheet of the cover, wherein said lugs (32, 34) are two in number and are symmetric with respect to the central bore (30) and wherein said lugs have transverse cross-sections substantially round with projecting longitudinal ribs (36).

6. The electric thermostat of claim 5, characterized in that said plate is of a polyamidic material loaded with fiber glass.

7. The electric thermostat of claim 6, characterized in that said plate has a rectangular shape.

* * * * *